US009958890B2

(12) United States Patent
Zanchi

(10) Patent No.: US 9,958,890 B2
(45) Date of Patent: May 1, 2018

(54) BIAS-STARVING CIRCUIT WITH PRECISION MONITORING LOOP FOR VOLTAGE REGULATORS WITH ENHANCED STABILITY

(71) Applicant: Aeroflex Colorado Springs Inc., Colorado Springs, CO (US)

(72) Inventor: Alfio Zanchi, Huntington Beach, CA (US)

(73) Assignee: AEROFLEX COLORADO SPRINGS INC., Colorado Springs, CO (US)

( * ) Notice: Subject to any disclaimer, the term of this patent is extended or adjusted under 35 U.S.C. 154(b) by 0 days. days.

(21) Appl. No.: 15/146,762

(22) Filed: May 4, 2016

(65) Prior Publication Data

US 2016/0246318 A1 Aug. 25, 2016

Related U.S. Application Data

(62) Division of application No. 12/816,841, filed on Jun. 16, 2010.

(51) Int. Cl.

| | |
|---|---|
| ***G05F 1/565*** | (2006.01) |
| ***G05F 1/575*** | (2006.01) |
| ***G05F 3/26*** | (2006.01) |

(52) U.S. Cl.

CPC ..... *G05F 1/575* (2013.01); *G05F 3/262* (2013.01)

(58) Field of Classification Search

CPC ..... G05F 1/575; G05F 1/56; G05F 1/573
USPC ..... 323/273–281
See application file for complete search history.

(56) References Cited

U.S. PATENT DOCUMENTS

| | | | |
|---|---|---|---|
| 5,637,992 | A | 6/1997 | Edwards |
| 5,744,944 | A | 4/1998 | Danstrom |
| 5,945,818 | A | 8/1999 | Edwards |
| 6,020,727 | A | 2/2000 | Bernard et al. |
| 6,031,363 | A | 2/2000 | Danstrom |
| 6,144,249 | A | 11/2000 | Tse |
| 6,333,669 | B1 | 12/2001 | Kobayashi et al. |
| 6,362,609 | B1 | 3/2002 | Gailhard |
| 6,465,994 | B1 | 10/2002 | Xi |
| 6,501,253 | B2 | 12/2002 | Marty |
| 6,677,737 | B2 | 1/2004 | Hamon et al. |
| 6,806,690 | B2 | 10/2004 | Xi |
| 6,993,772 | B2 | 1/2006 | Pike et al. |
| 7,417,416 | B2 | 8/2008 | Rasmus |
| 7,446,515 | B2 | 11/2008 | Wang |

(Continued)

FOREIGN PATENT DOCUMENTS

JP 2000322138 A 11/2000

*Primary Examiner* — Nguyen Tran
(74) *Attorney, Agent, or Firm* — Hogan Lovells US LLP

(57) ABSTRACT

A regulator circuit includes a voltage regulator having a stability control input and an output for providing a regulated output voltage, an amplifier circuit having an input for receiving an error voltage of the voltage regulator, and an output, and a control circuit having an input coupled to the output of the amplifier and an output coupled to the stability control input of the voltage regulator, such that the regulator stability is maximized while the error voltage is minimized. The voltage regulator includes an LDO voltage regulator, the amplifier circuit includes an operational amplifier circuit, and the control circuit includes a load-sensing or load-replicating circuit.

2 Claims, 13 Drawing Sheets

(56) References Cited

U.S. PATENT DOCUMENTS

| | | | | |
|---|---|---|---|---|
| 7,545,128 | B2 * | 6/2009 | Nakajikkoku | H03F 3/45183 323/281 |
| 7,907,074 | B2 | 3/2011 | Zanchi et al. | |
| 8,289,009 | B1 | 10/2012 | Strik et al. | |
| 2004/0004467 | A1 | 1/2004 | Miyanaga et al. | |
| 2009/0045789 | A1 | 2/2009 | Sasaki et al. | |
| 2009/0237048 | A1 | 9/2009 | Hou et al. | |
| 2011/0309808 | A1 | 12/2011 | Zanchi | |

* cited by examiner

BIAS-STARVING CIRCUIT WITH PRECISION MONITORING LOOP FOR VOLTAGE REGULATORS WITH ENHANCED STABILITY

RELATED CASE

The present application claims priority from, and is a divisional of, U.S. patent application Ser. No. 12/816,841 filed on Jun. 16, 2010 which is entitled "BIAS-STARVING CIRCUIT WITH PRECISION MONITORING LOOP FOR VOLTAGE REGULATORS WITH ENHANCED STABILITY" which is hereby incorporated by reference in its entirety for all purposes as if fully set forth herein.

BACKGROUND OF THE INVENTION

Field of the Invention

The present invention relates, in general, to voltage regulation circuits and, more particularly, to a bias-starving circuit for improving the stability of an LDO (Low-Drop Out) voltage regulator driving a switched capacitive load.

Relevant Background

Voltage regulation circuits are used to modify, tune, and stabilize off-chip voltages towards usage for on-chip supply rails. Besides the elimination, or substantial reduction, of RLC (Resistor, Inductor, Capacitor) package-induced voltage disturbances, regulators allow designs for a single supply voltage level without having to cover the ±5% to ±10% external supply variations. Such regulation circuits are often implemented with a topology comprised of an error amplifier OTA (Operational Transconductance Amplifier) and a driver device, and their output feeds a storage, or decoupling, capacitor $C_{out}$. The size of the driver device allows minimization of the ΔV between the externally provided supply rail V+ and the regulated voltage $V_{out}$, which justifies the name LDO's (Low Drop Out) used for such circuits.

A typical LDO regulation circuit 100 is shown in FIG. 1, and includes an operational amplifier 102 having a negative input for receiving an external $V_{REF}$ reference voltage, and a positive input having a $V_{REFL}$ reference voltage. The $V_{REFL}$ reference voltage is substantially equal to the $V_{REF}$ reference voltage due to the feedback circuitry described in further detail below. The output of amplifier 102 drives the gate of the P-channel driver transistor 104. The source of driver transistor 104 is coupled to the V+ supply voltage. The drain of driver transistor 104 is the output of the regulator, providing the $V_{OUT}$ output voltage. A feedback resistor $R_F$ is coupled between the $V_{OUT}$ output terminal and the positive input of amplifier 102. A trimmable resistor $R_S$ coupled between the positive input of amplifier 102 and ground allows adjustment of the $V_{OUT}$ voltage level. The controlling signal for setting the resistance of $R_S$ is often a digital word. The output of the regulator circuit 100 drives a load Z(s), as well as a storage, or decoupling, capacitance $C_{OUT}$. As is known by those skilled in the art, the regulated output voltage $V_{OUT}=V_{REF}*(R_F/R_S+1)$, and is substantially immune from variations in the V+ power supply voltage.

The impedance nature of the load Z(s) determines by and large the AC, i.e., the stability, characteristic of the regulation loop. LDO's feeding analog circuits often drive a $$Z(s) = R + \frac{1}{s \cdot C},$$

due to a part of the load drawing a continuous DC current and a part drawing a frequency-dependent current, usually associated with a capacitive load. The usually large (hundreds of milliAmps) currents drawn into the driver device guarantee a predictable bias current, and therefore, $g_m$, of the driver device (or circuit).

However, the LDO can be used to regulate an internal supply rail that feeds, e.g., only digital logic. In this case, if the logic is of the ECL (bipolar) type, its current consumption is also predictable; but in the CMOS case, the Z(s) load is exclusively of the capacitive kind, i.e.

$$Z(s) = \frac{1}{s \cdot C},$$

which is entirely frequency-dependent. The $g_m$ of the second stage, or driver, of the LDO, is therefore substantially changing with the switching frequency of the digital circuitry, since the DC current drawn by the switching capacitive loads is $I_{LOAD}(f)=C_{load} \cdot V_{DD} \cdot f$.

The load-dependent nature of the $I_{LOAD}$, and therefore of the $g_m$, of the driver stage of the LDO leads to stability issues of the regulator loop. It has been observed in the prior art that an increase in $g_m$ of the driver stage requires a compensating decrease in $g_m$, and slow-down of the poles, of the error amplifier in front of it. A technique of current-starving of the OTA controlling the driver performs a dominant-pole compensation of the loop, when the stabilizing effect of the R-C zero added to the Miller compensation scheme is diminished due to $g_m$ increase. In fact, two approaches can be followed for the regulator loop.

Firstly, a broad-band approach with fast poles in the amplifier requires cascading a number of low-gain stages, that adds a number of singularities in the Bode plot and can lead to lower precision of the loop (i.e. lower $G_{LOOP}$ values).

Secondly, a high-gain approach with a high-impedance OTA entails the presence of two poles (the main $C_{out}$ and $R_{out}$, and the OTA output impedance into the gate capacitance of the driver device), both quite slow, that is usually stabilized by way of a Left-Half Plane LHP zero, found at $$Z = \frac{1}{C_{COMP} \cdot \left(\frac{1}{g_m} - R_{COMP}\right)}$$

Some prior art techniques sense the changing load on the regulator by paralleling a second device to the main driver and feeding back its own current, to either modify a pole/zero compensation network or adaptively vary the driver current and/or the OTA current. These techniques inherently slave the loop bias to the desired output voltage, which however can be varied independent of the load's switching frequency.

While these known techniques provide some benefit for stabilizing an LDO regulator circuit, they all suffer from potential under or over correction. What is desired is a circuit and method of stabilizing an LDO regulator while monitoring the final precision of the regulated voltage against the desired set-up point, with even greater precision and control than is possible given the current state of the art.

SUMMARY OF THE INVENTION

A regulator circuit includes a voltage regulator having a stability control input and an output for providing a regulated output voltage, an amplifier circuit having an input for receiving an error voltage of the voltage regulator, and an output, and a control circuit having an input coupled to the output of the amplifier and an output coupled to the stability control input of the voltage regulator, such that the regulator stability is maximized while the error voltage is minimized. In a preferred embodiment, the voltage regulator includes an LDO voltage regulator, the amplifier circuit includes an operational amplifier circuit, and the control circuit includes a frequency-to-current converter.

BRIEF DESCRIPTION OF THE DRAWINGS

The foregoing and other features, utilities and advantages of the invention will be apparent from the following more particular description of an embodiment of the invention as illustrated in the accompanying drawings, in which.

DETAILED DESCRIPTION

Figure 1:
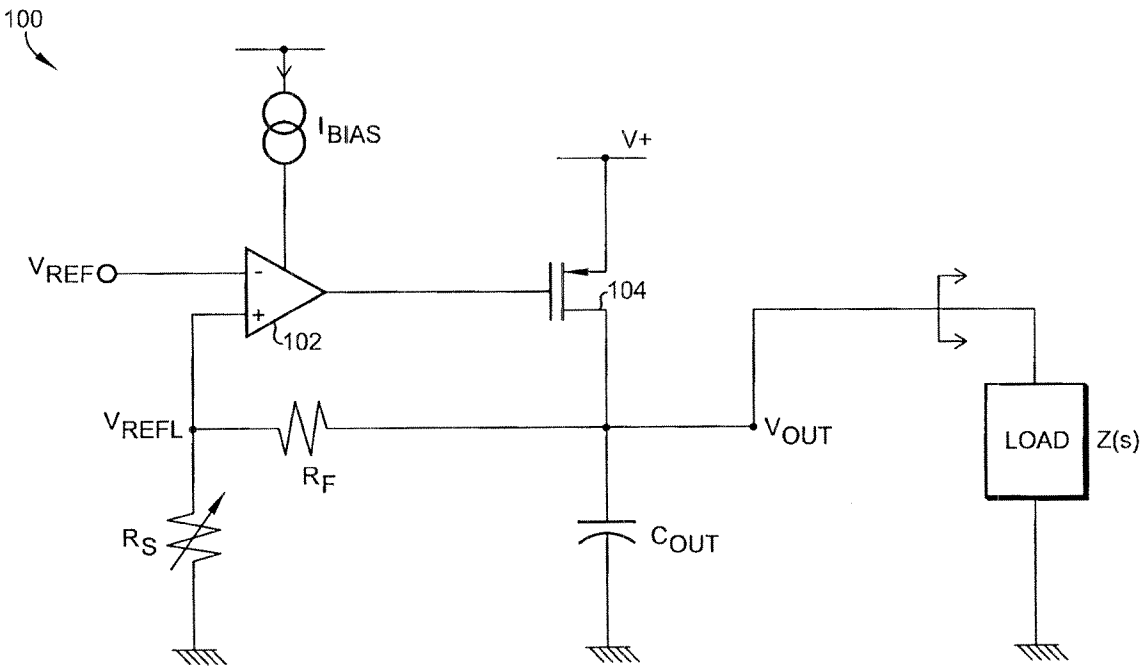
Fig. 1 Prior Art
FIG. 1 is a schematic diagram of a prior art LDO regulator having a P-channel driver transistor for driving a capacitive load.
Figure 2:
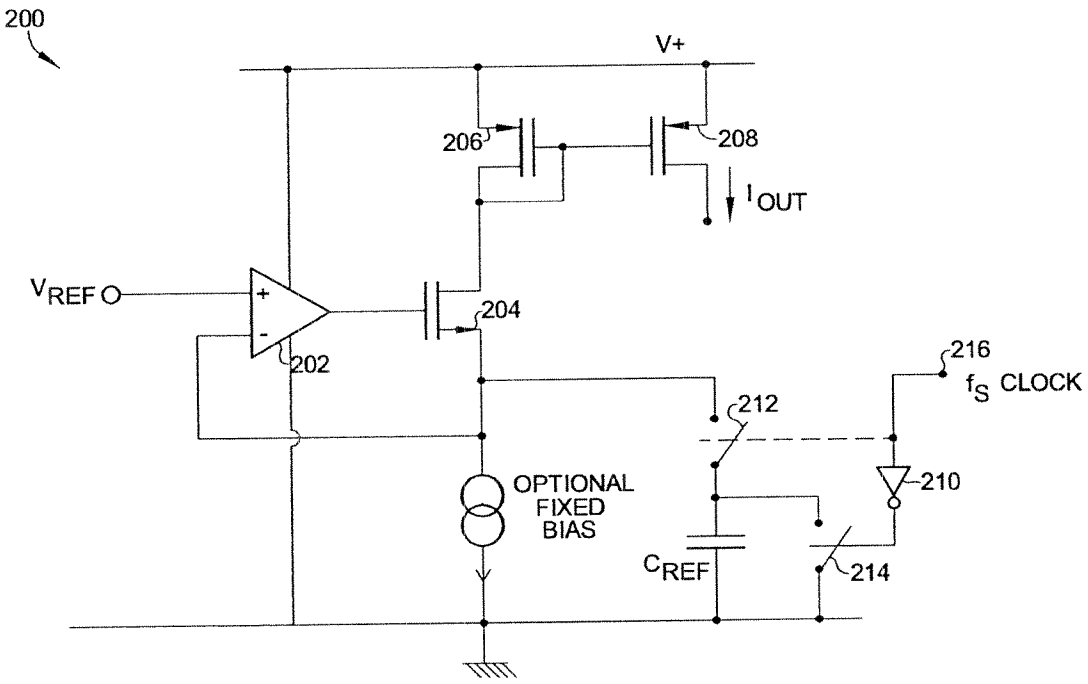
FIG. 2 is a schematic diagram of a prior art F-to-I (Frequency to Current) converter for providing an output current in response to the switching frequency of a capacitive load.

In order to isolate the current variations in the load due to frequency variations of a switching capacitor network from other exogenous causes of the same variations, the proposed circuit employs a replica loop with a fixed reference voltage, known as a F-to-I (Frequency to Current) converter as is shown in FIG. 2.

Converter 200 includes an operational amplifier 202, whose positive input is coupled to a $V_{REF}$ input reference voltage. The output of operational amplifier is coupled to the gate of N-channel driver transistor 204. The source of transistor 204 is coupled to a reference capacitor $C_{REF}$ through a switch 212. The source of transistor 204 is also coupled to a fixed bias current source, if desired. The reference capacitor is shunted by switch 214. Switches 212 and 214 are controlled through the action of inverter 210, which receives a clock signal at node 216. The output current $I_{OUT}$ of converter 200 can either be taken directly at the drain of transistor 204, or optionally through a current mirror including diode-connected transistor 206 and output transistor 208.

Since $I_{out}=C_{ref}\cdot V_{ref}\cdot f_s$ once the loop is settled, this circuit mimics the $I_{load}$ requested to the LDO, but without any dependence on the $V_{out}$ level as set for the LDO; and especially, without being affected by any line disturbances affecting the output of the LDO, that would be injected into the loop bias as in the prior art. The adoption of a complementary device with regards to the one used in the LDO driver is here useful (a diode can read $I_{out}$ on the drain), but not essential.

Figure 3:
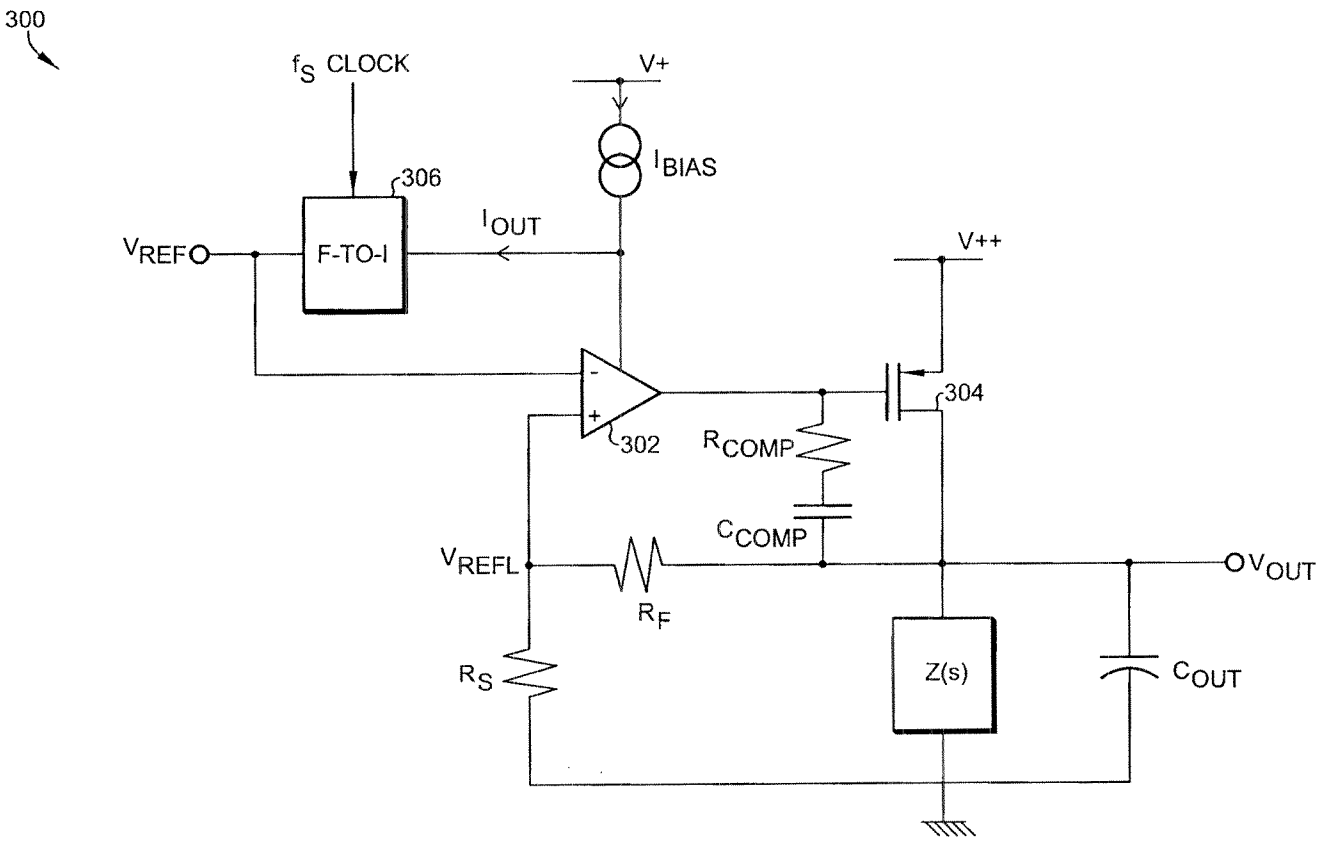
FIG. 3 is a schematic diagram of a prior art bias-starving circuit including an LDO regulator and a F-to-I converter for improving stability.

Referring now to FIG. 3, the $I_{out} \propto f$ can now be subtracted from the operational amplifier 302 (OTA) bias current $I_{BIAS}$ of the main LDO loop, as shown in circuit 300. Circuit 300 includes an operational amplifier 302 coupled to a P-channel driver transistor 304, gain-setting resistors $R_S$ and $R_F$, compensation elements $R_{COMP}$ and $C_{COMP}$, as well as load Z(s) and storage, or decoupling, capacitor $C_{OUT}$ coupled to the output terminal $V_{OUT}$. The converter 306 receives the same reference voltage $V_{REF}$ that is coupled to the negative input of operational amplifier 302, as well as the input clock signal. The $I_{OUT}$ current is subtracted from the $I_{BIAS}$ current. Different $V_{ref}$ values can be employed for the LDO and F-to-I converter, provided they are constant. An additional NMOSFET mirror applied to $I_{out}$ in FIG. 2 can be used to implement the F-to-I block in the diagram of FIG. 3.

The circuit 300 shown in FIG. 3 provides stability when driving capacitive loads and prevents locked states that are possible in the prior art. However, circuit 300 suffers from potential current source and current mirror mismatches. In fact, to achieve stability at high $f_s$, a large fraction of $I_{bias}$ has to be absorbed by the F-to-I block 306. Therefore, errors of mirroring, or parasitic capacitors $C_{par}$ that add to the ideal capacitor $C_{ref}$, could alter the current starving circuit generating an over-correction and could potentially shut down the entire LDO.

Figure 4:
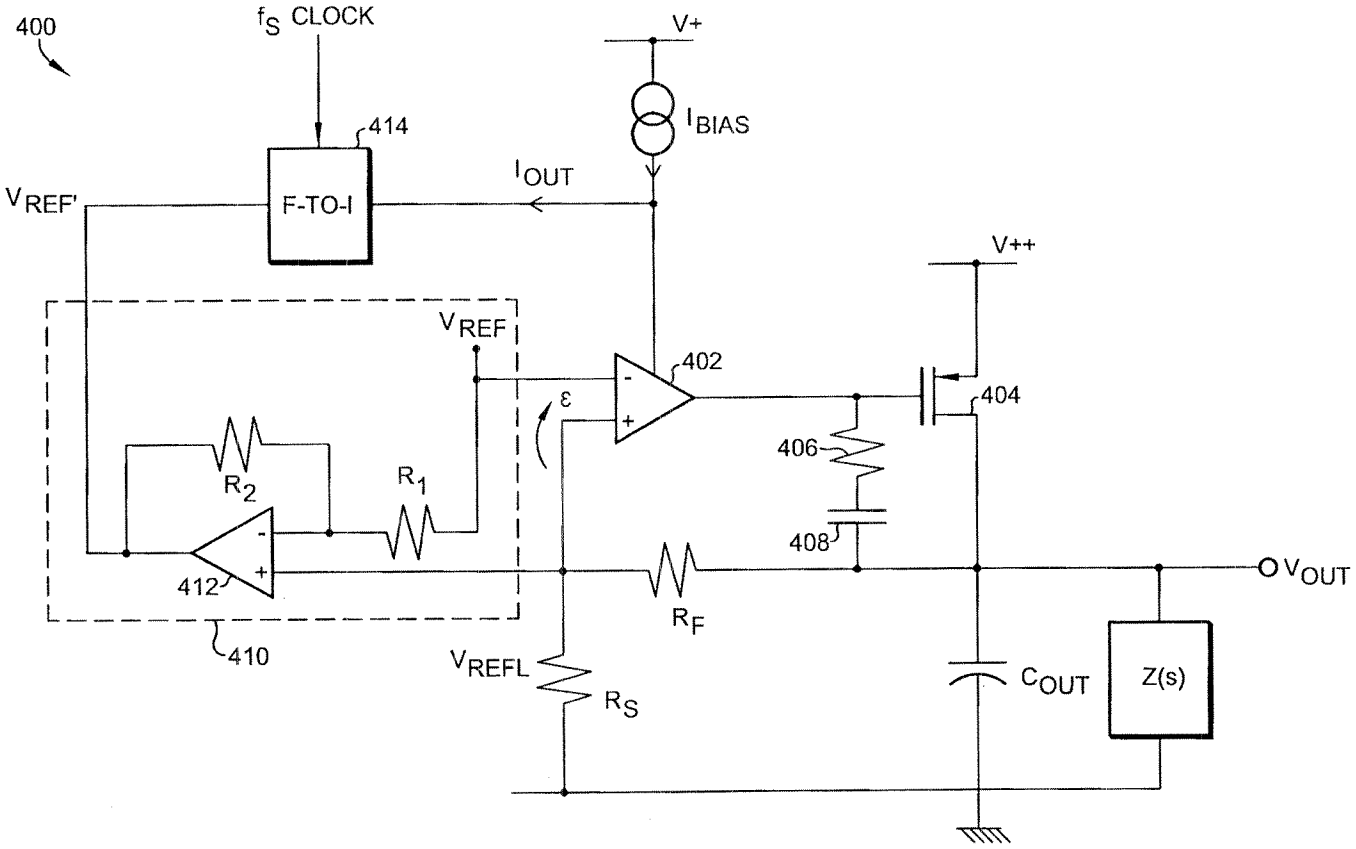
FIG. 4 is a schematic diagram of a first embodiment of a bias-starving circuit including a precision monitoring loop according to the present invention.

A solution according to the present invention is proposed against such risk that monitors the precision of the LDO feedback node tracking of $V_{ref}$, and detects potential DC errors by re-biasing the OTA within the loop in case of long-term errors. One embodiment of such correction block is implemented in voltage mode as shown in FIG. 4.

Circuit 400 includes on LDO regulator circuit with an operational amplifier 402. Operational amplifier 402 is coupled to a P-channel driver transistor 404, gain-setting resistors $R_S$ and $R_F$, compensation elements $R_{COMP}$ and $C_{COMP}$, as well as load Z(s) and $C_{OUT}$ coupled to the output terminal $V_{OUT}$. The reference voltage $V_{REF}$ is coupled to the negative input of operational amplifier 402, as well as to the input of an additional voltage amplifier circuit 410 including operational amplifier 412 and further including gain-setting resistors $R_1$ and $R_2$. The negative input of amplifier 412 is coupled to the VREF reference voltage through resistor R1. The positive input of amplifier 412 is coupled to the positive input of amplifier 402. The output of operational amplifier 412 provides a $V_{REF}'$ reference voltage. F-to-I converter 414 receives the $V_{REF}'$ reference voltage, the input clock signal, and generates an output current as shown. The $I_{OUT}$ current is then subtracted from the $I_{BIAS}$ current.

In circuit 400, the feedback error $\epsilon=V_{refl}-V_{ref}$ is sensed; is recognized as due to a bias error starving the OTA; is amplified, and used to modulate the $I_{OUT}$ value until a correct bias is established that allows the OTA to make $\epsilon\rightarrow 0$. In FIG. 4:

$$V'_{ref} = V_{refl}\cdot\left(1+\frac{R_2}{R_1}\right) - V_{ref}\cdot\frac{R_2}{R_1} = V_{refl} + \frac{R_2}{R_1}\cdot\varepsilon$$

can be used to diminish $V_{ref}'$, and consequently $I_{out}=C_{ref}\cdot V_{ref}'\cdot f_s$, when $V_{refl}$ is too low, i.e. when the loop gain is insufficient. $R_2/R_1$ ratios of 100 or so can be used in this respect. An ideal integrated configuration can be used to drive to zero the long-term error. Notice that this servo-loop can both decrease or increase the $I_{bias}$ depending on the sign of $\epsilon$, but—while excess of $I_{bias}$ will compromise stability, but not drive $\epsilon>0$—the lack of $I_{bias}$, will drive $\epsilon<0$ and steer the loop in the direction of $\epsilon \rightarrow 0$.

Figure 5:
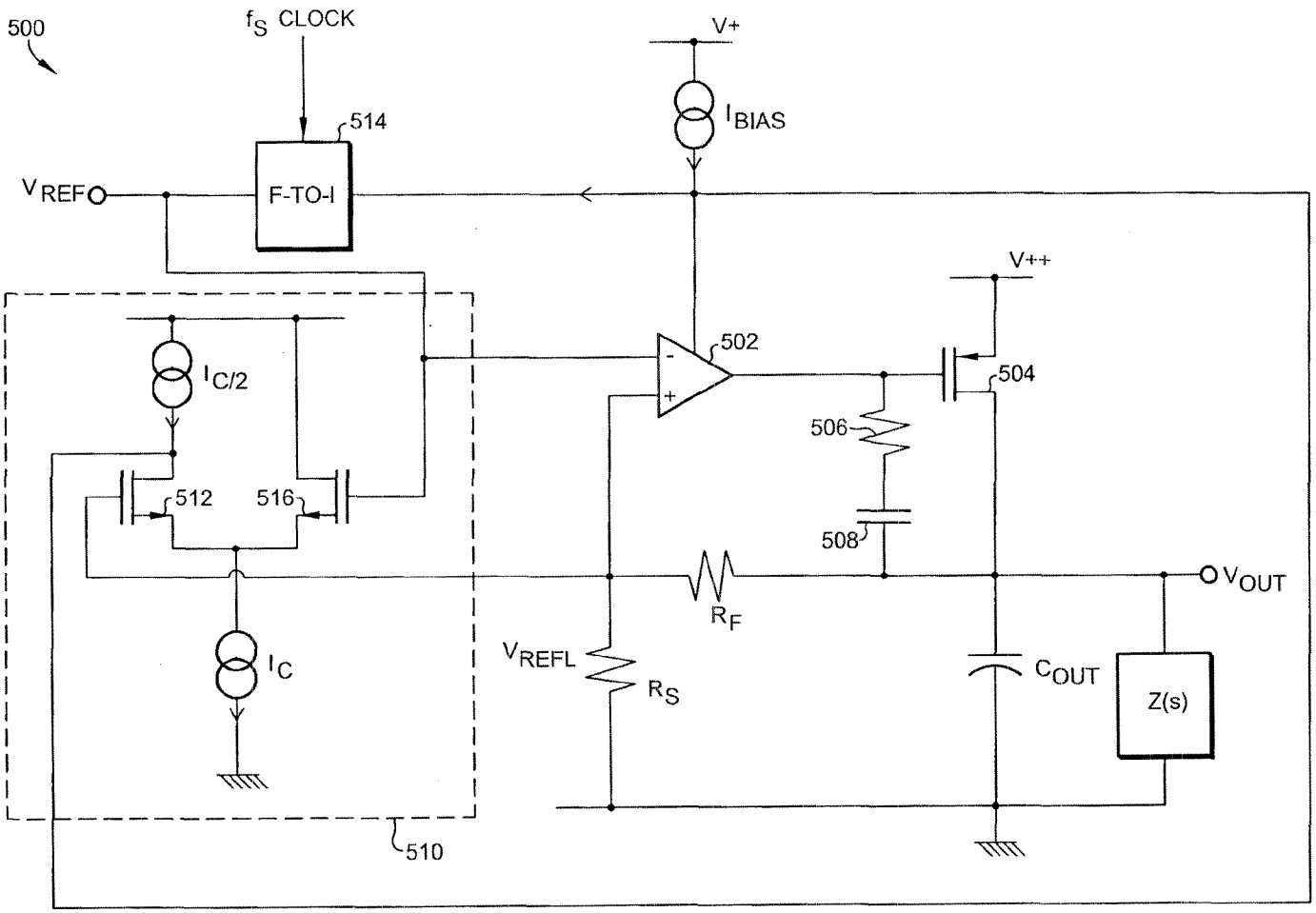
FIG. 5 is a schematic diagram of a second embodiment of a bias-starving circuit including a precision monitoring loop according to the present invention.

An implementation of the stabilization loop according to the present invention has been devised in the current domain and is shown as circuit 500 in FIG. 5. LDO circuit including operational amplifier 502, driver transistor 504, compensation resistor 506, and compensation capacitor 508 are substantially the same as have been described with respect to FIG. 4. The loads and the converter circuit 514 are substantially the same as have been previously described as well. Note, however, that the voltage amplifier circuit 410 shown in FIG. 4 has been replaced by a current-mode circuit 510. Current-mode circuit 510 includes transistors 512 and 516, and current sources $I_C$ and $I_C/2$. The gate of transistor 512 is coupled to the positive input of amplifier 502, and the gate of transistor 516 is coupled to the negative input of amplifier 502.

In FIG. 5, the matched current sources $I_C$ and $I_C/2$ provide a current correction range of $(-I_c/2, +I_c/2)$ which can be provided back to the LDO bias in case a starvation due to current mismatch is detected. The value of $I_C$ can be chosen small enough to cover the possible mismatch percentage of the main bias current (10, or 20% of $I_{bias}$, is usually largely adequate), with low consumption and low impact of the bias monitor loop on the LDO stability. Again, the loop can provide an increase or decrease in the bias current, but the long-term starvation of the regulation loop drives $\epsilon \rightarrow 0$. This additional loop is for long-term monitoring of the $I_{bias}$ of the LDO and can be therefore heavily lowpass filtered, in such a way as to not interact with the faster dynamic of the LDO, which has been separately optimized by controlling the $I_{bias}$ of the OTA in the loop. Depending on the polarity of a faster error (e.g. the one detected during settling), the additional bias monitor loop can actually speed up and help the LDO output transient.

The present implementation of a stabilized loop reduces ringing in response to a step settling test, and increases the phase margin $\varphi_M$ of the LDO loop when the frequency $f_s$ is raised. For applications in which the frequency of the clock $f_s$ has to be variable, e.g., in ratios of 1 MSps (Mega Samples per second) to 200+ MSps, adoption of such bias control is instrumental to prevent ringing of the LDO response; especially when the current in the driver stage is almost exclusively due to capacitive charge/discharge, which takes the current from a few microamps to a few milliAmps.

The simulated time-domain diagrams of FIGS. 6-13 show the improvement in stability, speed, and precision realized by the circuit of the present invention.

Figure 6:
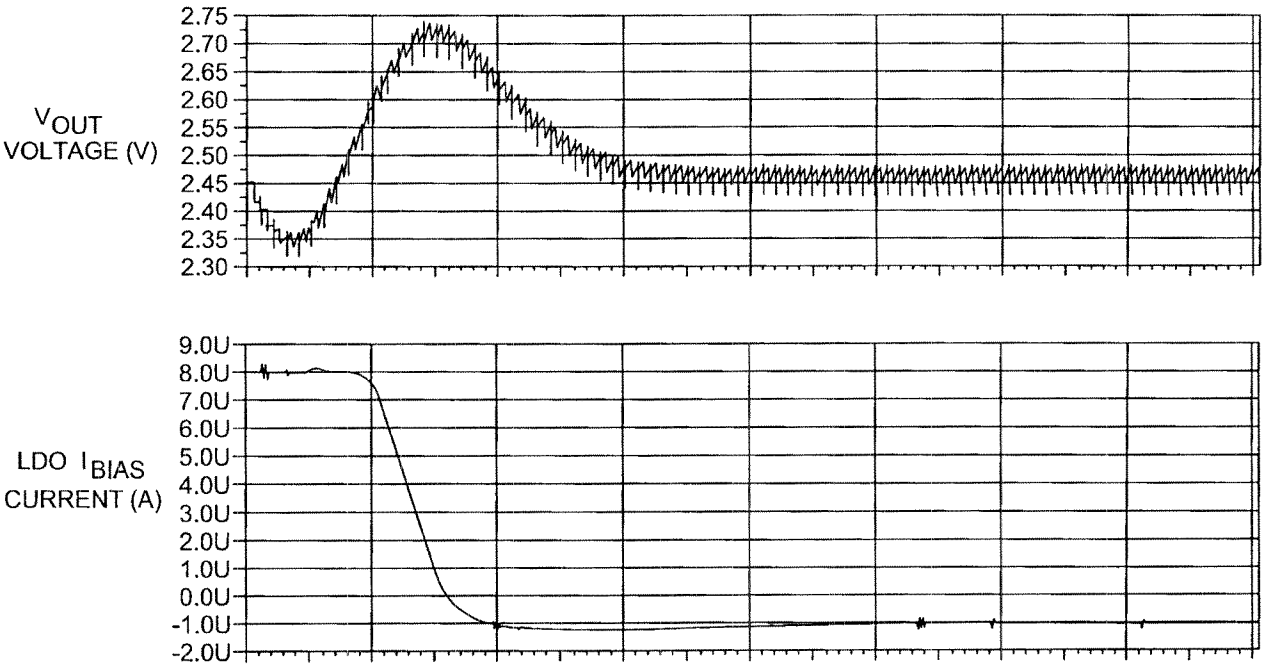
FIGS. 6-13 are simulation graphs illustrating the stability, speed, and precision improvements realized with the circuit of the present invention.

FIG. 6 shows the unacceptable degradation in precision of the regulator output 300 depicted in FIG. 3, and nominally set to 2.95V, when the nominal bias current of 12 μA is affected by ~30% error and the effective bias current IBIAS feeding the OTA 302 is down to 8 μA. The current starving output of 306 is assumed instead to be ~9 μA at the frequency of interest, which after the bias control has settled leads to a complete de-biasing of the LDO, and as a consequence to an erroneous output of 2.47V against the 2.95V desired.

Figure 7:
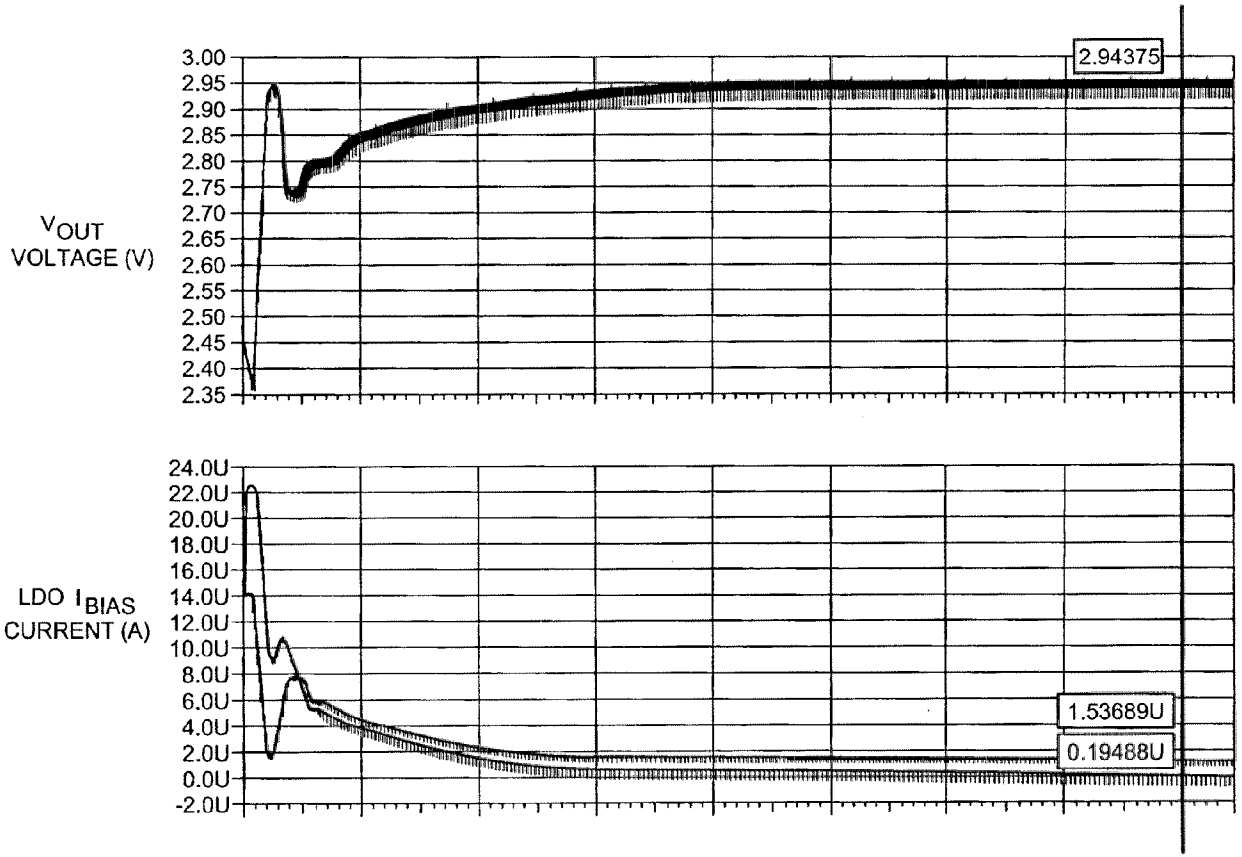

FIG. 7 shows the main advantage provided by the invention, i.e. the precision of the regulator output—as it is recovered due to the circuit 400 shown in FIG. 4, and nominally set to 2.95V, when the nominal bias current of 12 μA is affected by ~30% error and the effective bias current IBIAS feeding the OTA 402 is down to 8 μA. The current starving output of 414 is assumed instead to be 9 μA at the frequency of interest, which forces the precision-monitoring error amplifier 410 to lower the bias starving output of 414, leaving the OTA 402 biased to a level sufficient to yield an output of ~2.94375V, or very close to the target voltage. Even for a 50% error in IBIAS (6 μA as opposed to 12 μA) the loop can still correct the LDO output within 50 mV of the target output as proven in simulation.

Figure 8:
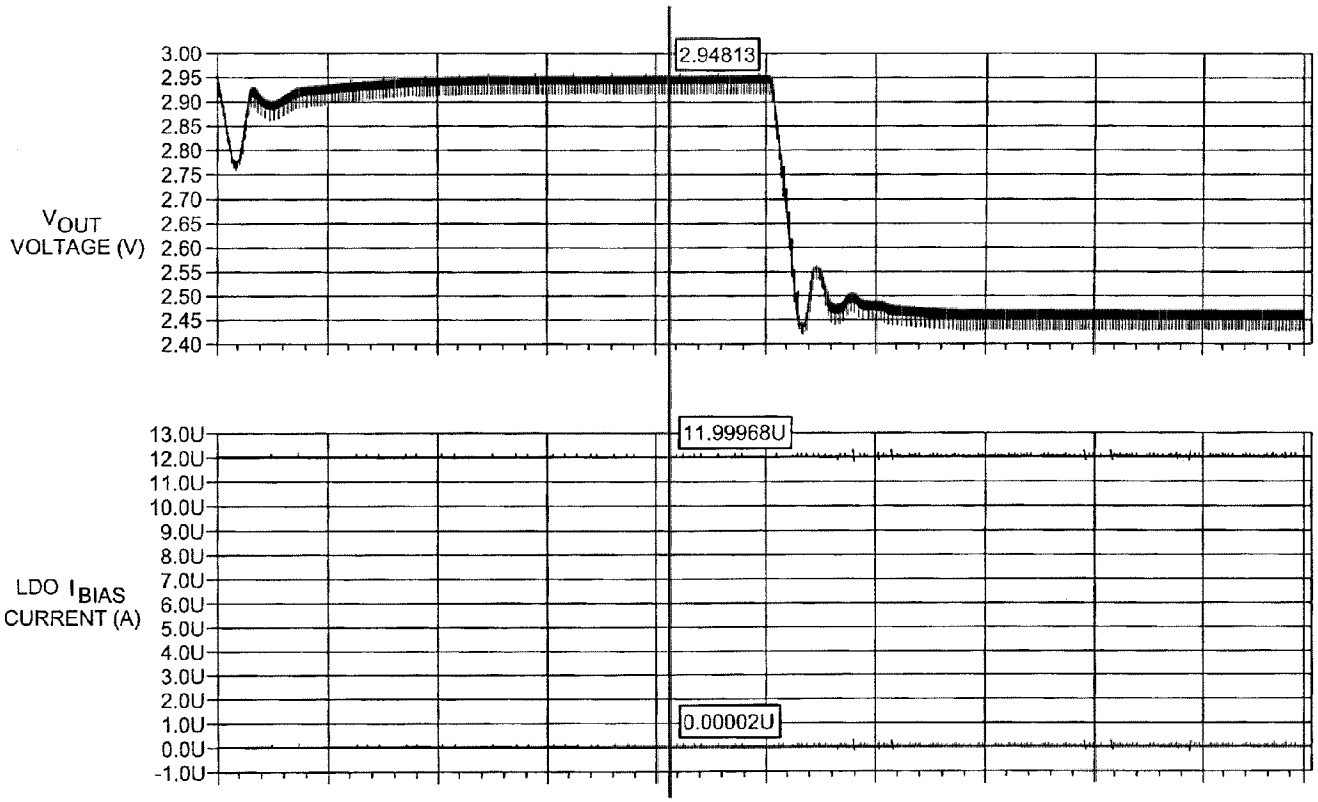

FIG. 8 shows an example of the prior art regulator (100) output transient while being trimmed from maximum to minimum of the voltage regulation range. In FIG. 8, the LDO is biased with the nominal 12 μA, and the down-going transition shows some under-damped ringing around the final target of 2.45V.

Figure 9:
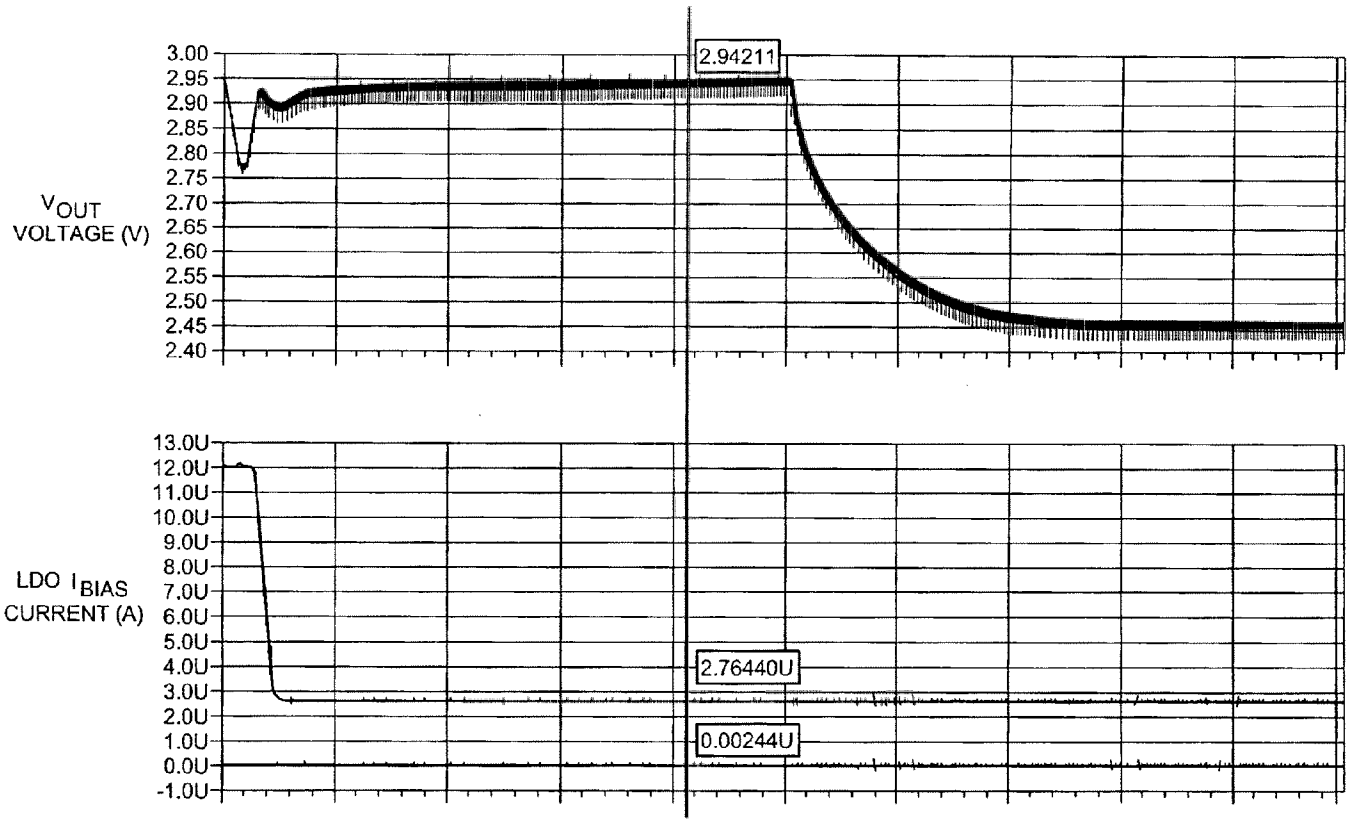

FIG. 9 shows an example of the regulator (300) output transient while being trimmed from maximum to minimum of the range, showing the enhanced stability guaranteed by the current-starving approach. In FIG. 9, the LDO is biased with the nominal 12 μA, of which the bias starving circuit 306 draws ~9 μA away from the OTA 302, slowing down the loop and providing a very over-damped down-going transition to the target of 2.45V.

Figure 10:
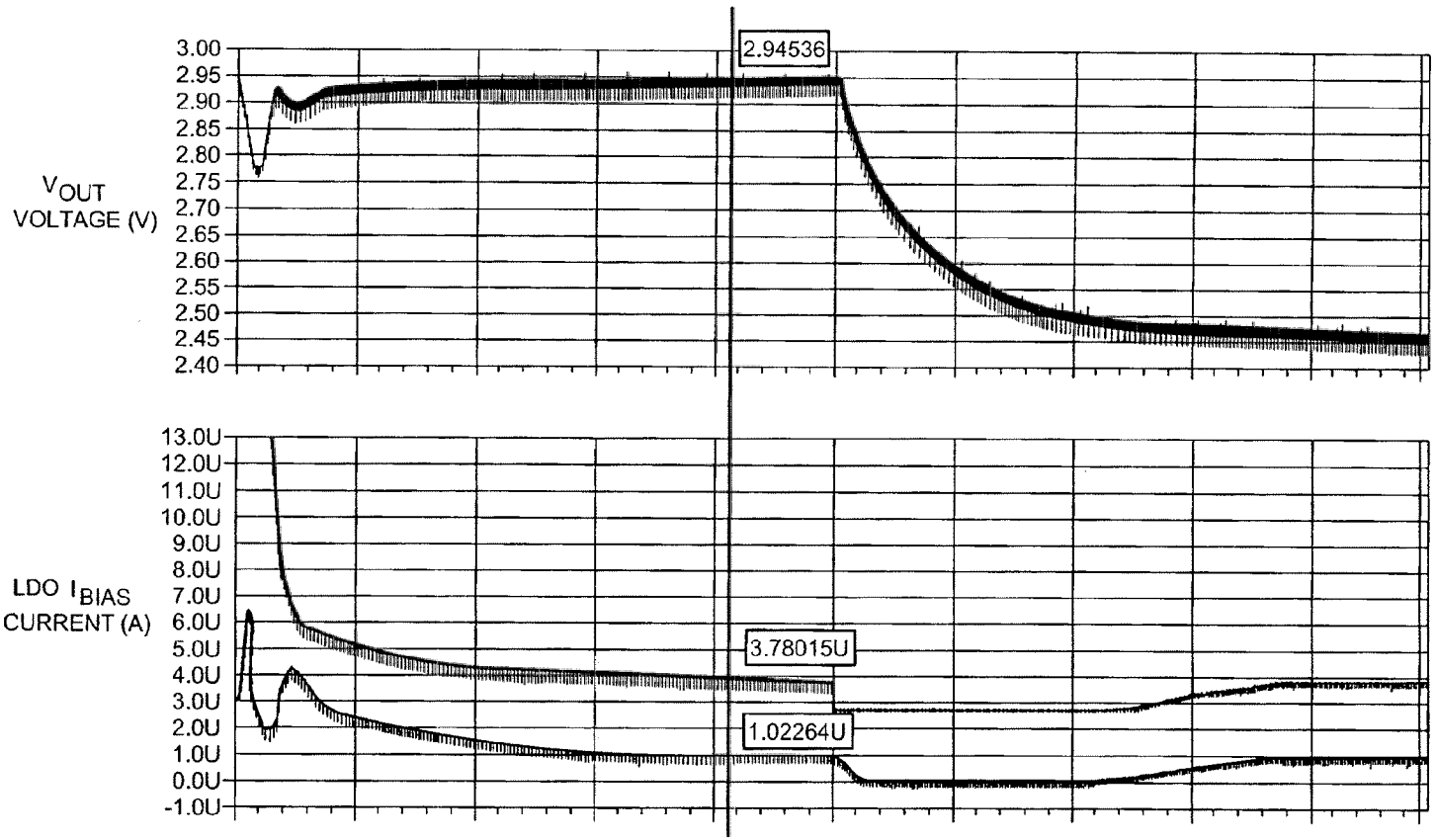

FIG. 10 shows an example of the invention regulator with precision-monitoring servo loop (400) output transient while being trimmed from maximum to minimum of the range, to further highlight the enhanced stability guaranteed by the current-starving approach, along with the neutral effect provided by circuit 410 over a descending transient. In FIG. 10, the LDO is biased with the nominal 12 μA, of which the bias starving circuit 306 draws μ9 μA away from the OTA 302. The output transient slowly falling to its target voltage is interpreted by the precision-monitoring loop as an accuracy error, prompting the loop to temporarily starve the bias level to less than 3 μA which however barely impacts the transient while maintaining a safely over-damped output transition. The trailing end of the simulation shows how the final bias level converges to the same 3 μA shown in FIG. 9.

Figure 11:
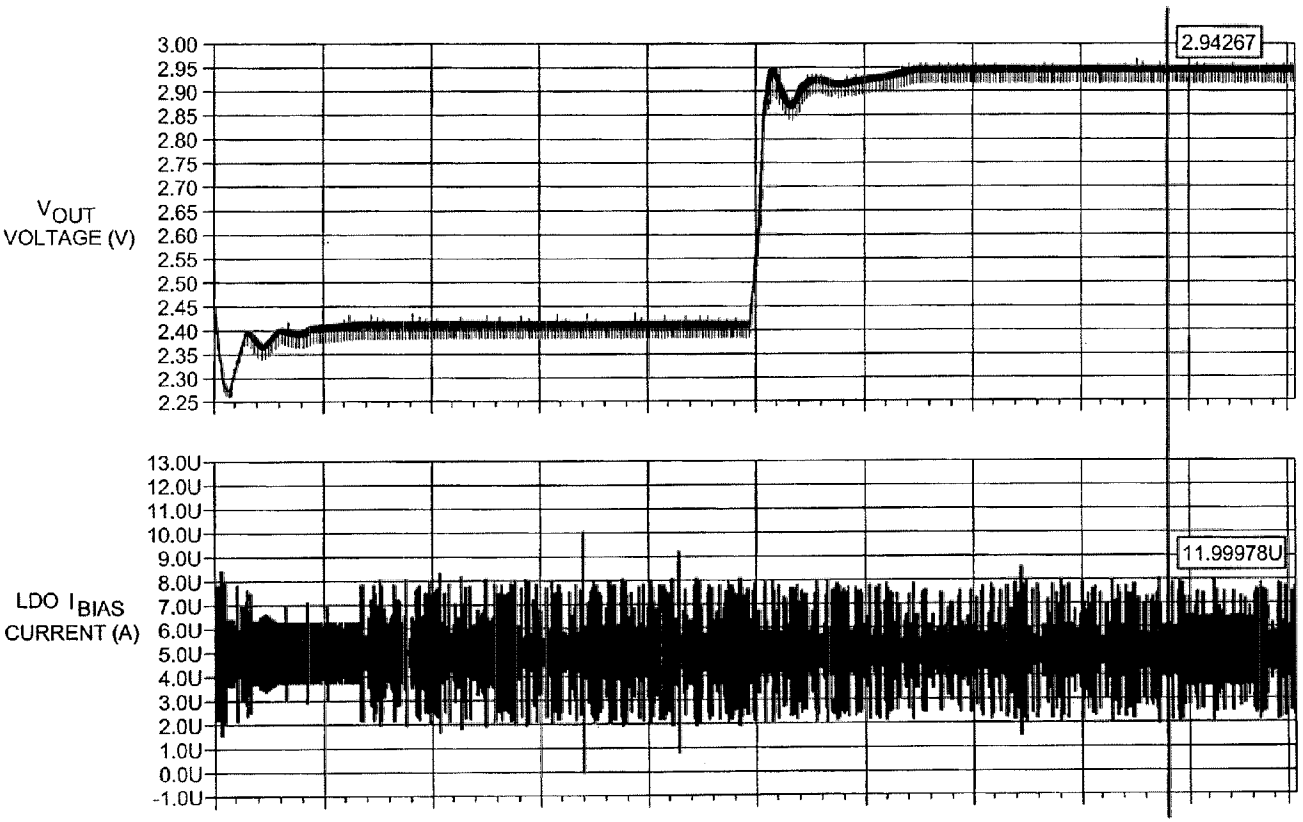

FIG. 11 shows an example of the prior art regulator (100) output transient while being trimmed from minimum to maximum of the voltage regulation range. In FIG. 11, the LDO is biased with the nominal 12 μA, and the up-going transition shows some under-damped ringing around the target 2.95V.

Figure 12:
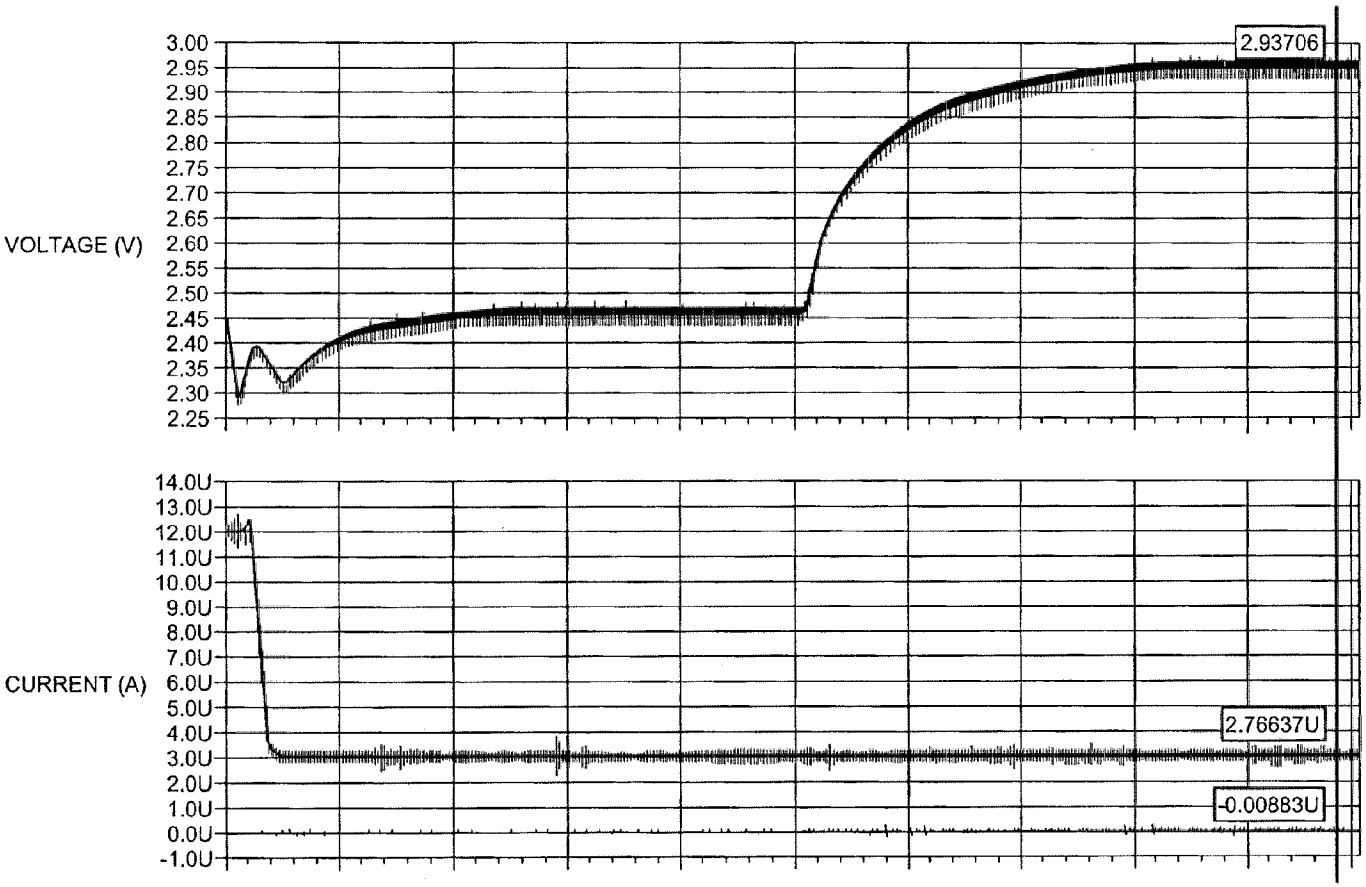

FIG. 12 shows an example of the regulator (300) output transient while being trimmed from minimum to maximum of the range, showing the enhanced stability guaranteed by the current-starving approach. In FIG. 12, the LDO is biased with the nominal 12 μA, of which the bias starving circuit 306 draws ~9 μA away from the OTA 302, slowing down the loop and providing a very over-damped up-going transition to the target 2.95V.

Figure 13:
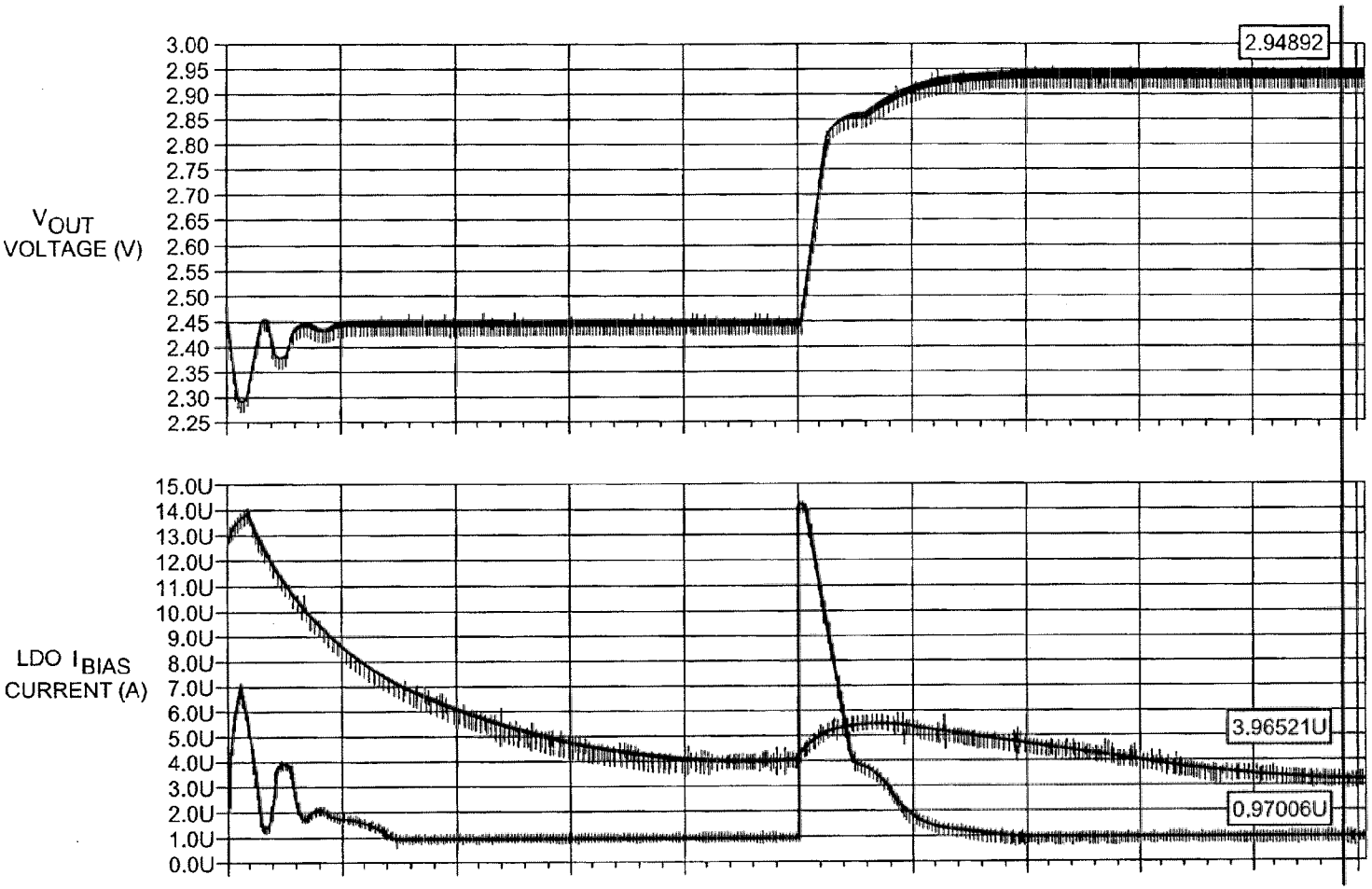

FIG. 13 shows an example of the invention regulator with precision-monitoring servo loop (400) output transient while being trimmed from minimum to maximum of the range, to further highlight the enhanced stability guaranteed by the current-starving approach, along with the speed-up provided by circuit 410 over an ascending transient. In FIG. 13, the LDO is biased with the nominal 12 μA, of which the bias starving circuit 306 draws ~9 μA away from the OTA 302. However, the output transient slowly rising to its target voltage is interpreted by the precision-monitoring loop as an accuracy error, prompting the loop to temporarily restore the bias level to 6.5 μA which speeds up the transient while maintaining a safely over-damped output transition. The trailing end of the simulation shows how the final bias level converges to the same 3 μA shown in FIG. 12.

While the invention has been particularly shown and described with reference to a preferred embodiment thereof, it will be understood by those skilled in the art that various other changes in the form and details may be made without departing from the spirit and scope of the invention. For example, while a "bias control circuit" that replicates the actions of a switched capacitive load has been shown as a frequency-to-current converter in FIGS. 4 and 5, it will be appreciated by those skilled in the art that any load-sensing circuit such as a load current shunt, or a load current mirroring circuit, or a load current attenuating or amplifying circuit; or any load-replicating circuit, such as an identical copy of the load circuit, or an approximate copy of the load current that captures the load variations against exogenous parameters such as temperature, supply, bias, trim code status, or switching frequency, can be used instead and the present invention is not limited to the frequency-to-current converter embodiment as shown. Also, while current and voltage error amplifier embodiments have been shown with respect to FIGS. 4 and 5, it will be appreciated by those skilled in the art that many such error amplifier embodiments are also possible. The present invention, therefore, is only limited by the following claims.

I claim:

1. A regulator circuit system comprising:

a voltage regulator portion comprising a stability control input, a voltage output configured to provide a regulated output voltage, a voltage regulator output current, an active feedback loop, a first voltage input configured to receive an external reference voltage, and a second voltage input configured to receive a feedback voltage, wherein the difference between the external reference voltage and the feedback voltage defines an error voltage;

an amplifier circuit portion comprising an operational amplifier, the operational amplifier comprising an error voltage input and an amplifier circuit output, wherein the error voltage input is configured to receive the error voltage of the voltage regulator portion; and a control circuit portion comprising a frequency-to-current converter, wherein the amplifier circuit output is an input to the frequency-to-current converter, and wherein an output of the frequency-to-current converter is coupled to the stability control input of the voltage regulator portion, such that regulator stability is maximized while the error voltage is minimized, wherein the amplifier circuit portion is configured to amplify the error voltage to provide either a modified reference voltage to the control circuit portion or a correction current to the stability control input of the voltage regulator portion.

2. The regulator circuit system as in claim 1 wherein the voltage regulator portion comprises a low-drop out (LDO) voltage regulator.

* * * * *